United States Patent [19]

Goettel et al.

[11] 3,938,413

[45] Feb. 17, 1976

[54] EXTRUSION PREPARATION APPARATUS

[76] Inventors: Robert J. Goettel; Richard J. Goettel, both of 2727 W. Weldon Ave., Phoenix, Ariz. 85017; Willis D. Smith, 4050 W. Palo Verde Drive, Phoenix, Ariz. 85019

[22] Filed: Aug. 12, 1974

[21] Appl. No.: 496,567

[52] U.S. Cl. ..... 83/145; 83/228; 83/440; 83/444; 83/581; 83/622; 83/636; 83/917

[51] Int. Cl.[2] ..... B26D 7/06

[58] Field of Search ..... 83/145, 146, 440, 440.1, 83/444, 446, 447, 448, 449, 450, 560, 581, 620, 622, 635, 636, 693, 694, 917, 228; 408/72, 72 B, 87

[56] References Cited

UNITED STATES PATENTS

| | | | |
|---|---|---|---|
| 1,241,254 | 9/1917 | Payne et al. | 83/560 X |
| 1,241,255 | 9/1917 | Hawthorne | 83/560 X |
| 1,638,526 | 8/1927 | Christie | 83/622 X |
| 2,163,641 | 6/1939 | Wales | 83/560 X |
| 3,026,754 | 3/1962 | Hartup | 83/635 X |
| 3,391,593 | 7/1968 | Jordan | 83/560 X |
| 3,572,204 | 3/1971 | McConnell | 83/560 X |
| 3,667,333 | 6/1972 | Flynn | 83/560 X |
| 3,817,135 | 6/1974 | Valente | 83/560 X |
| 3,848,497 | 11/1974 | Lancaster et al. | 83/620 X |

*Primary Examiner*—J. M. Meister
*Assistant Examiner*—Fred A. Silverberg
*Attorney, Agent, or Firm*—Herbert E. Haynes, Jr.

[57] ABSTRACT

Multiflanged extrusion preparation apparatus including means by which multiflanged elongated extrusions are aligningly fed to punch press operated dies which notch, trim, and otherwise prepare the extrusions for use in assembling and installing of fiberboard air handling ducts.

5 Claims, 12 Drawing Figures

EXTRUSION PREPARATION APPARATUS

BACKGROUND OF THE INVENTION

1. Field of the Invention

This invention relates to a punch apparatus and more particularly to an apparatus for preparing elongated multiflanged extrusions for use in conjunction with fiberboard air handling ducts.

2. Description of the Prior Art

Air handling ducts of the type employed in heating and refrigeration systems have traditionally been formed of sheet metal, with a recently developed alternative being to form the ducts of insulative fiberboard. In many instances, the fiberboard ducts have an advantage over metal ducts due to such factors as weight, insulative properties, cost, and the labor involved.

However, fiberboard ducts have not achieved the acceptance they deserve due to the problems of assembling individual lengths of ducting and of interconnecting adjacent lengths thereof.

The fiberboard material employed in the air handling ducts is supplied in sheets, with the individual lengths of ducting being formed by longitudinally folding the sheet so that its opposite side edges are in contiguous abutting contact with each other and the resulting duct is either of square or rectangular cross sectional configuration. The abutting side edges of the fiberboard material are sealingly interconnected with tape, and the assembly of individual lengths of ducting into a complete duct system is accomplished in a similar manner by interconnecting adjacent lengths of the ducting with tape.

The use of tape as an assembly and closure material has, in many instances, been found to be unsatisfactory due to temperature, pressure and other factors causing the tape to lost its adhesive grip on the fiberboard material which, of course, will cause leakage of the duct system and in some cases can allow complete collapsing of the system.

Elongated multiflanged extrusions are now being employed in place of the above described tape for assembly and closure of the fiberboard ducts. Extrusions for this purpose are disclosed in U.S. Pat. No. 3,677,579, issued on July 18, 1972 to W. N. LaVanchy.

Briefly, a first type of extrusion, sometimes referred to as a longitudinal extrusion, is being employed for sealingly interconnecting the side edges of the fiberboard sheet to form the individual lengths of ducting.

Other configurations of extrusions, as determined by the type of interconnection desired, are being employed on the open ends of the individual ducts to facilitate interconnection of adjacent lengths of ducting. These latter extrusions may be referred to as joint extrusions.

Due to the great variations in lengths and cross sectional sizes of ducts, the above described extrusions are supplied in straight pieces which are individually prepared for installation and assembly when the specific sizes and configuration of the ducting are known.

Therefore, the longitudinal extrusions must be cut to the proper length and also must be provided with a recessed notch at each of their opposite ends to allow assembly of the joint extrusions to the fiberboard ducting.

The joint extrusions, which are also supplied in straight pieces, must be notched in specific locations along the length thereof to allow these extrusions to be bent into either the square or rectangular configuration suitable for mounting on the ends of the ducting. Also, the joint extrusions have a hanger flange which allows the assembled duct system to be suspendingly mounted therefrom. The hanger flange must be punched or otherwise provided with hanger holes at the proper locations.

Notching, cutting, and otherwise preparing the multiflanged extrusions for use with the fiberboard ducts is, in some instances, being accomplished with hand tools. Obviously, this is a very tedius, time consuming, and costly method, so a prior art apparatus for accomplishing these tasks was developed.

This prior art apparatus is a complex, slow operating and inadequately designed machine which has achieved only limited acceptance for those reasons as well as the cost which has placed this apparatus beyond the economic justification of many companies doing this sort of work.

Therefore, a need exists for a new and improved extrusion preparation apparatus which overcomes some of the problems of the prior art.

SUMMARY OF THE INVENTION

The multiflanged extrusion preparation apparatus of the present invention includes an input channel and an output channel aligningly positioned on opposite sides of the workpiece supporting plate of a suitable punch press. These channels serve as a feeding means by which the extrusion workpieces are fed through and punched by one of two interchangeable die sets, with the particular die set being determined by the type of extrusion being processed.

Each of the die sets are demountably attachable to the work piece supporting plate of the punch press, and each includes a fixed bottom pedestal and a movable top plate. The fixed pedestal of each of the die sets includes a fixture die means especially designed to slidingly receive the extrusion and to supportingly position the extrusion for the punching operation. The top plate of each of the die sections is reciprocally movable toward the pedestal by means of the punch press and includes the cutting die means which is especially designed to punch the extrusion as required.

Accordingly, it is an object of the present invention to provide a new and improved extrusion preparation apparatus.

Another object of the present invention is to provide a new and improved extrusion preparation apparatus which is economical to manufacture and efficient to operate.

Another object of the present invention is to provide a new and improved extrusion preparation apparatus which prepares elongated multiflanged extrusions for use in assembling and installing air handling ducts of the type fabricated of insulative fiberboard.

Another object of the present invention is to provide a new and improved extrusion preparation apparatus which employs exchangeable die sets for preparing various types of elongated multiflanged extrusions for use in assembling and installing fiberboard air handling ducts.

The foregoing and other objects of the present invention, as well as the invention itself, will be more fully understood from the following description when read in conjunction with the accompanying drawings.

DESCRIPTION OF THE PREFERRED EMBODIMENT

Figure 1:
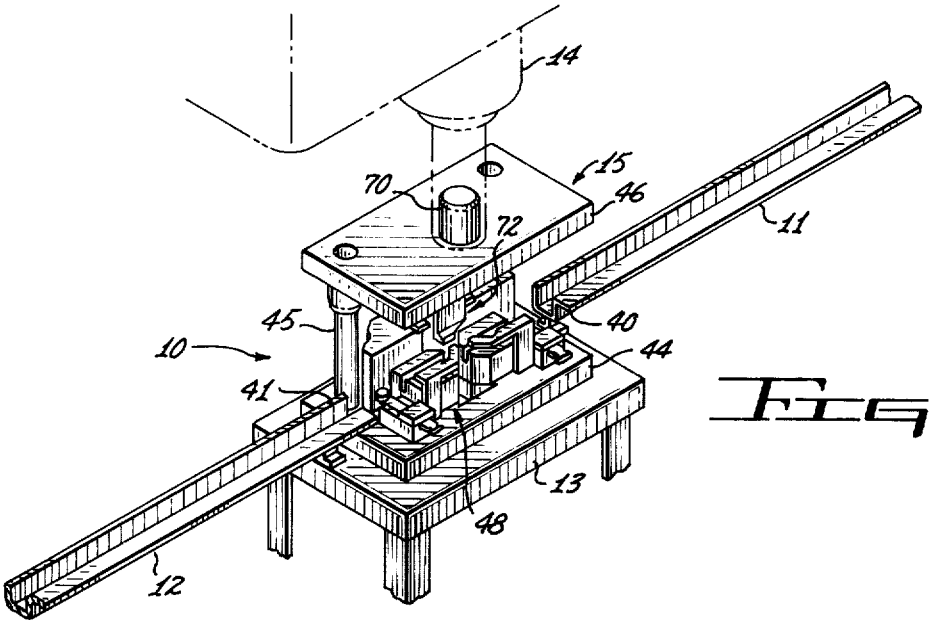
FIG. 1 is a perspective view of the multiflanged extrusion preparation apparatus of the present invention which illustrates the various features thereof.

Referring more particularly to the drawings, FIG. 1 illustrates the multiflanged extrusion preparation apparatus of the present invention which is indicated generally by the reference numeral 10. The apparatus 10 is shown to include an input channel 11 and an output channel 12 which are alignigly positioned on opposite side edges of a support plate 13. The support plate 13 may be a free standing structure as shown, or may be formed integral with a suitable punch press 14. In either instance, the support plate 13 serves as a carrying means for a die set 15. The die set 15 is one of an interchangeable pair of die sets 15 and 16, with the die set 15 being shown in FIGS. 1, and 5 through 8, and the die set 16 being shown in FIGS. 9 through 12. The die sets 15 and 16 are demountably attachable to the support plate 13 and are suitably coupled to the punch press 14 for reciprocal operation thereby as will hereinafter be described in detail.

It is believed that a more thorough understanding of the objects and operation of the apparatus 10 of the present invention will be achieved if the design and purposes of the various types of multiflanged extrusions or workpieces, are known. Therefore, FIGS. 2 and 3 show extrusions 17 and 18, respectively, which are of the type referred to as joint extrusions, and FIG. 4 shows a longitudinal extrusion 19.

Figure 2:
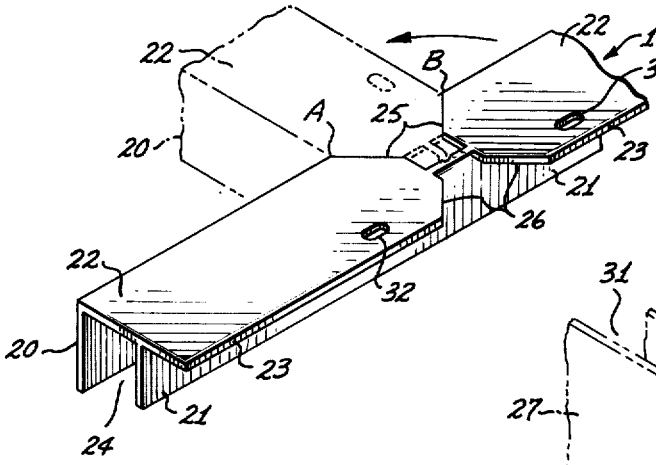
FIG. 2 is a fragmentary perspective view of one type of multiflanged extrusion after having been processed by the apparatus of the present invention.

The multiflanged extrusion 17, shown in FIG. 2, is a U-shaped in cross section elongated member having an inner flange 20, an outer flange 21 and an interconnecting surface 22 which extends beyond the outer flange 21 to form a hanger flange 23. The inner flange 20, outer flange 21 and interconnecting surface 22 define an open channel 24 for receiving the edge of fiberboard ducting material (not shown). This edge of the ducting material (not shown) is formed either into a square or rectangular end configuration of the duct and thus, the extrusion 17 must be bent at various points along its length to conform to this end configuration. Bending of the extrusion 17 requires that a portion, between points A and B of the inner flange 20, be removed, a V-shaped notch 25 be formed in the interconnecting surface 22, and that a V-shaped notch 26 be formed in the hanger flange 23. It will be noted that the outer flange 21 is left intact so that complete severing of the extrusion will not occur. After removal of the portion between points A and B and forming of the notches 25 and 26, the extrusion 17 can be bent into the dashed line position shown in FIG. 2 to form a square corner.

Figure 3:
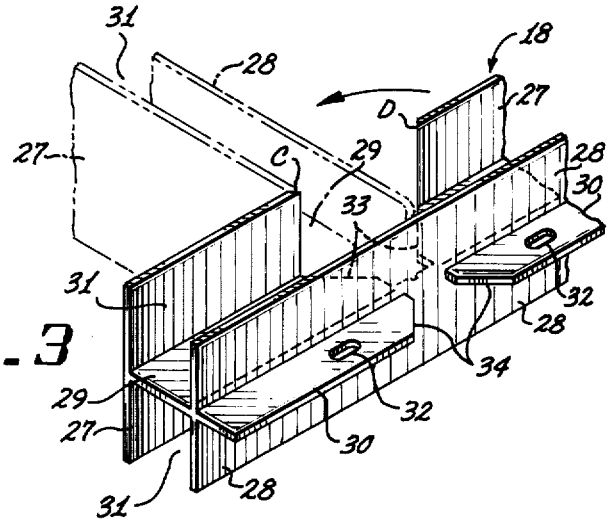
FIG. 3 is a fragmentary perspective view of another type of multiflanged extrusion after having been processed by the apparatus of the present invention.
Figure 4:
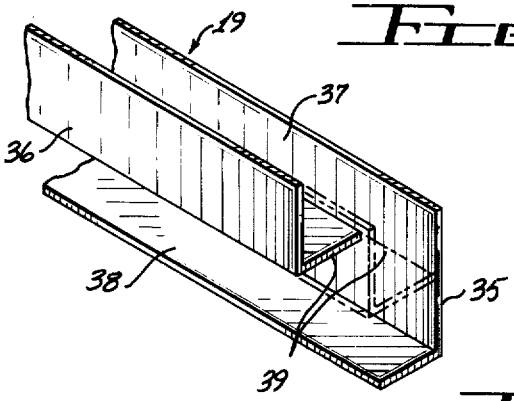
FIG. 4 is a fragmentary perspective view of still another type of multiflanged extrusion after having been processed by the apparatus of the present invention.

The extrusion 18 shown in FIG. 3 is H-shaped in cross section and has an inner flange 27, an outer flange 28 and a midpoint interconnecting surface 29 which is coplanar with a hanger flange 30 extending from the midpoint of the outer flange 28. The H-shaped configuration of the extrusion 18 defines back to back open channels 31 for receiving the open end edges (not shown) of two adjacent fiberboard ducting members (not shown). Thus, as was required with the extrusion 17, the extrusion 18 must be bent to conform to the end configuration of the lengths of ducting (not shown). To accomplish this bending of the extrusion 18, the portion between points C and D of the inner flange 27 must be removed, and V-shaped notches 33 and 34 must be formed in the interconnecting surface 29 and the hanger flange 30, respectively. As was the case with regard to extrusion 17, the outer flange 28 of the extrusion 18 is left intact, and the extrusion 18 is bent into the dashed line position to form a square corner.

It will be seen that both of the extrusions 17 and 18 are provided with oval shaped apertures 32 formed through their respective hanger flanges 23 and 30. These apertures 32 are employed for installation purposes of the assembled ducting system (not shown) and may be formed simultaneously with the above described extrusion preparation.

The longitudinal extrusion 19, as shown in FIG. 4, has a main angle member 35 with a secondary angle member 36 extending from one of the legs of the member 35. These angle members 35 and 36 are configured to define a pair of channels 37 and 38 which are adapted to receive the opposite side edges of a sheet of insulative fiberboard material (not shown) when that material is shaped to form a length of air handling duct (not shown). The extrusion 19 is supplied in elongated straight pieces and must be cut to the proper length and also must be notched at its opposite ends to allow mounting of the joint extrusions 17 or 18 on the ends of the duct (not shown). Thus, preparation of the extrusion 19 requires severing of the extrusion into predetermined lengths and requires that the secondary angle member 36 be formed with a notch 39 by removing the amount thereof which is shown in dashed lines in FIG. 4.

Figure 5:
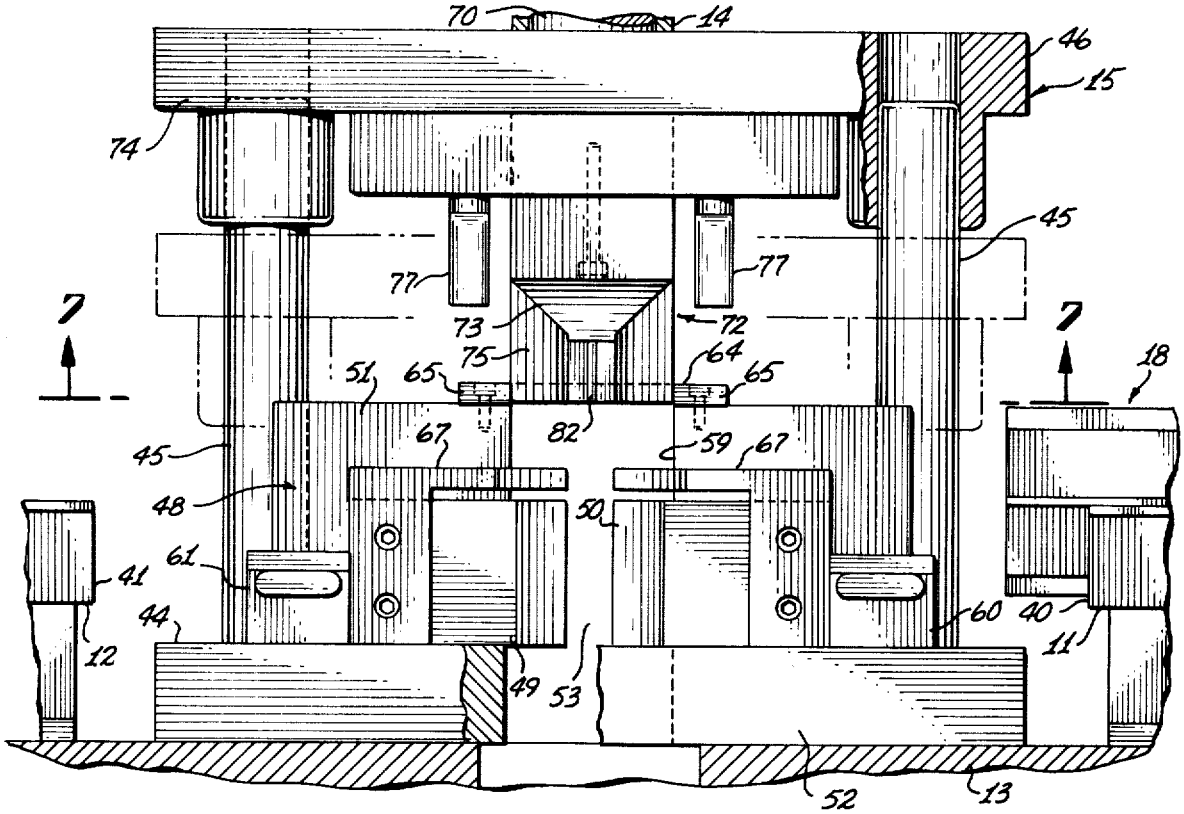
FIG. 5 is a front elevational view of one of the die sets employed in the apparatus of the present invention.

Referring now to FIGS. 5 through 8 wherein the die set 15 is shown as being mounted on the support plate 13, and as shown in FIG. 5 is alignigly disposed between the discharge end 40 of the input channel 11, and the receiving end 41 of the output channel 12.

The die set 15 includes a fixed pedestal 44 having a pair of vertical rods 45 extending therefrom. The rods 45 serve as supporting guideways for a movable top plate 46 which is slidably journaled on the rods for reciprocal movement toward and away from the pedestal 44, as will hereinafter be described. The pedestal 44 also has a matrix or fixture die means 48 mounted thereon which guides movement of the workpieces into a predetermined path through the die set 15 and supports these workpieces for the punching operation as will hereinafter be described.

Figure 8:
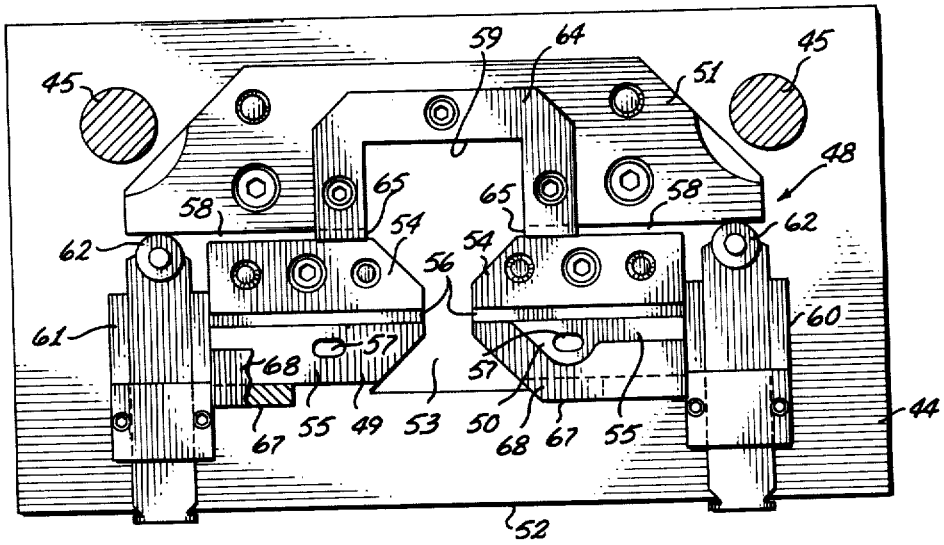
FIG. 8 is a sectional view taken on the line 8—8 of FIG. 6.

The fixture die means 48, as seen best in FIG. 8, includes a pair of support dies 49 and 50 and a backup die 51. The support dies 49 and 50 are mounted adjacent to the front edge 52 of the pedestal 44 and are spaced apart with respect to each other to provide a gap 53 therebetween. Each of the supporting dies 49 and 50 are provided with a rearwardly disposed portion 54 of their upper surface and a forwardly disposed portion 55 thereof which are separated by a horizontally extending vertical channel 56 formed in the dies 49 and 50. The forward portion 55 of each of the dies 49 and 50 is also formed with a vertically extending oval shaped aperture 57 therein. The backup die 51 is mounted on the pedestal 44 so as to be rearwardly disposed from the support dies 49 and 50 to provide a horizontally extending vertical passage 58 therebetween. The backup die 51 is also provided with a vertically extending channel 59 intermediate its ends which is aligned with the gap 53 between the support dies 49 and 50.

To facilitate understanding of the movement guiding and supporting functions of the fixture die means 48, the positioning of the extrusion 18 therein will now be described. The horizontally extending vertical passage 58, between the support dies 49 and 50 and the backup die 51, is adapted to receive the inner flange 27 of the extrusion 18 which is oriented so that the midpoint interconnecting surface 29 rests on the rearwardly disposed portions 54 of the support dies 49 and 50. The hanger flange 30 of the extrusion 18 will rest on the forwardly disposed portions 55 of the dies 49 and 50, and the outer flange 28 of the extrusion 18 is received in the horizontally extending vertical channels 56 formed in the dies 49 and 50. It should be understood that the above described positioning of the extrusion 18 within the fixture die means 48 also applies to the extrusion 17, as either of these extrusions can be prepared for assembly and installation within the die set 15. Thus, it may now be seen that the fixture die means 48 provides a horizontally extending workpiece supporting and movement path which is transverse to the gap 53 and channel 59 thereof.

A spring loaded roller mechanism 60 is provided at the workpiece input end of the fixture die means 48 and another spring loaded roller mechanism 61 is located at the workpiece output end of the fixture die means. The roller mechanisms 60 and 61 are mounted on the pedestal 44 and are disposed so that the rollers 62 thereof are biased, by suitable springs 63 (one shown in FIG. 6), toward the backup die 51. These mechanisms 60 and 61 are employed to load the workpiece into sliding engagement with the backup die 51 which is accomplished by the rollers 62 bearing on the lower edge of the inner flange 27 of the extrusion 18 or the lower edge of the inner flange 20 of the extrusion 17.

As seen best in FIG. 8 a U-shaped stripper 64 is provided on the backup die 51, and that stripper is disposed so as to conform to and overlay the vertically extending channel 59 formed in the backup die. The stripper 64 is provided with extending ends 65 which protrude laterally from the backup die 51 over the passage 58 between the backup die 51 and the support dies 49 and 50. The extending ends 65 of the stripper 64 prevent upward movement of the workpiece as will become apparent as the desription progresses.

Each of the support dies 49 and 50 have a stripper 67 mounted thereon, and these strippers 67 each have a cantilevered bar 68 which extends proximate the apertures 57 formed in the support dies 49 and 50 and also extend toward the gap 53 between these dies. The strippers 67 also serve to prevent upward movement of the workpiece as will become apparent as the description progresses.

As hereinbefore mentioned, the top plate 46 of the die set 15 is reciprocally movable on the vertical guide rods 45, and this movement is provided by a punch press mechanism 14. It should be apparent that various types of punch presses could be employed; however, it is preferred that an electric clutch operated flywheel type of press be employed.

The top plate 46 is provided with a boss 70 extending upwardly therefrom to which the punch press 14 is suitably coupled, and the plate 46 has cutting die means 72 depending from the downwardly facing surface thereof, so that the cutting die means 72 will be reciprocally movable in a path which transversely intersects the workpiece supporting and movement path formed in the fixture die means 48.

Figure 6:
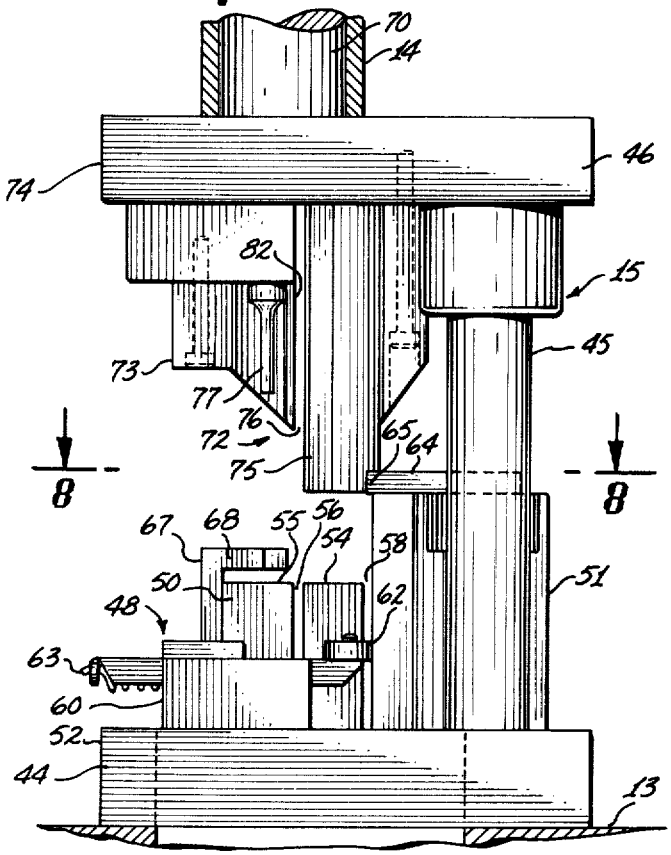
FIG. 6 is a side elevational view of the die set shown in FIG. 5.
Figure 7:
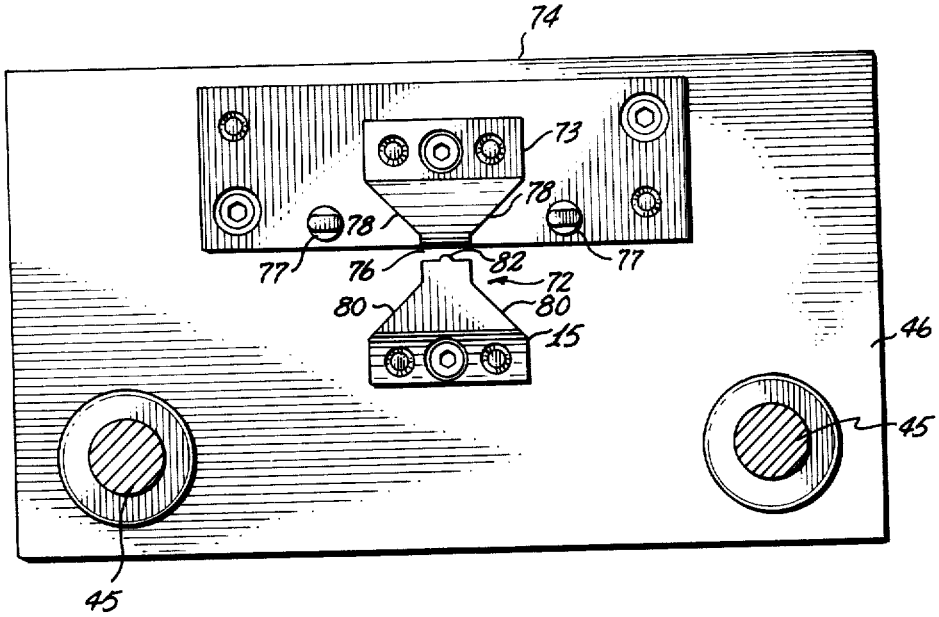
FIG. 7 is a sectional view taken on the line 7—7 of FIG. 5.

As best seen in FIGS. 6 and 7, the cutting die means 72 includes a first cutting die 73 which is mounted adjacent the front edge 74 of the plate 46, and a second cutting die 75 that is spaced rearwardly from the first cutting die 73 to provide a recess 76 therebetween. The die means 72 also includes a pair of oval shaped punches 77, each positioned adjacent an opposite side of the first cutting die 73.

The first cutting die 73 has a pair of vertically extending angularly disposed surfaces 78 in a V-shaped configuration. This first cutting die 73 is positioned in vertical alignment with the forward position of the gap 53 provided between the support dies 49 and 50 of the fixture die means 48. Thus, downward movement of the plate 46 will move the first cutting die 73 into the forward portion of the gap 53, and this movement will punch out the V-shaped notch 26 in the hanger flange 23 of the extrusion 17, or the V-shaped notch 34 of the hanger flange 30 of extrusion 18 depending on which of these extrusions is positioned within the die set 15.

The second cutting die 75 is also provided with a pair of vertically extending surfaces 80 which are angularly disposed to form a V-shaped configuration. This second cutting die 75 is positioned in vertical alignment with the rearwardly disposed portion of the gap 53 between the support dies 49 and 50 and also aligns with the vertically extending channel 59 formed in the backup die 51. Thus, upon downward movement of the plate 46, the second cutting die 75 will move into the rear portion of the gap 53 and the channel 59 of the backup die 51. It will be noted that when the second cutting die 75 moves downwardly as described above, it will also move into the passage 58 between the support dies 49 and 50 and the backup die 51. Therefore, when the extrusion 17 is positioned within the die set 15, the second cutting die 75 will punch the V-shaped notch 25 in the interconnecting surface 22 of the extrusion 17, and also will remove the portion of material between the points A and B of the inner flange 20. Likewise, when the extrusion 18 is positioned within the die set 15, downward movement of the second cutting die 75 will punch the V-shaped notch 33 in the midpoint interconnecting surface 29, and will remove the material between the points C and D of the inner flange 27.

As hereinbefore described, the first and second cutting dies 73 and 75, respectively, are spaced apart with respect to each other to provide the recess 76 therebetween. This recess 76 is in alignment with the channel 56 formed in the supporting dies 49 and 50 so that when extrusion 17 is positioned in the die set 15, its outer flange 21 which is positioned in the channel 56 will not be touched by either of the cutting dies 73 or 75. Also, the extrusion 18 is positioned in the die set 15, the outer flange 28 thereof will be left intact. The recess 76 is somewhat larger than the thickness of the outer flanges 21 and 28, respectively, of the extrusions 17 and 18, thus a protruding lip (not shown) portion of the interconnecting surfaces 22 and 29, respectively, will remain. The second cutting die 75 is provided with a protrusion 82 which notches the protruding lip (not shown) so that uniform bending of the extrusions 17 and 18 will be possible.

The oval shaped punches 77 of the cutting die means 72 are in vertical alignment with the vertically extending aperture 57 formed in the front portions 55 of the supporting dies 49 and 50. These punches 77 will move into and out of the apertures 57 upon reciprocal movement of the top plate 46, and thus may be seen to be employed to punch the oval mounting apertures 32 in the hanger flanges 23 and 30 of the extrusions 17 and 18, respectively, as determined by which of these extrusions is positioned in the die set 15.

Figure 9:
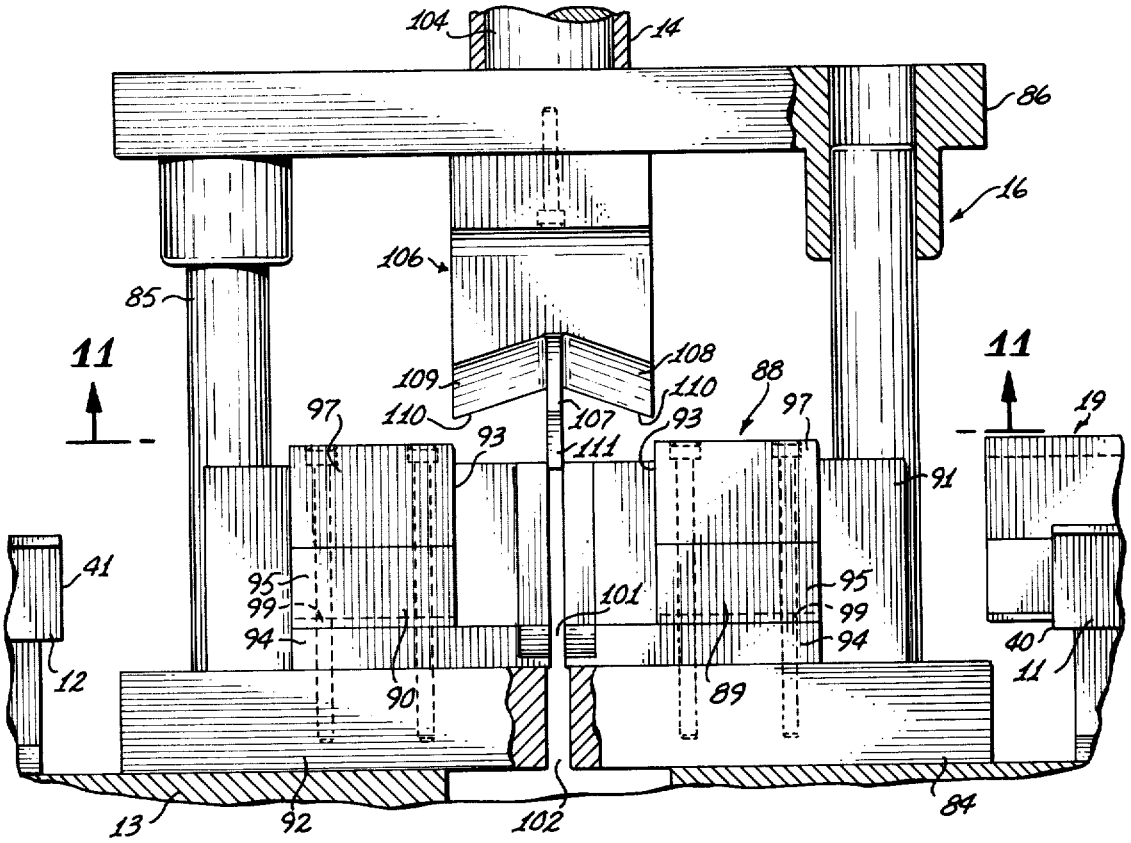
FIG. 9 is a front elevational view of another one of the die sets employed in the apparatus of the present invention.
Figure 10:
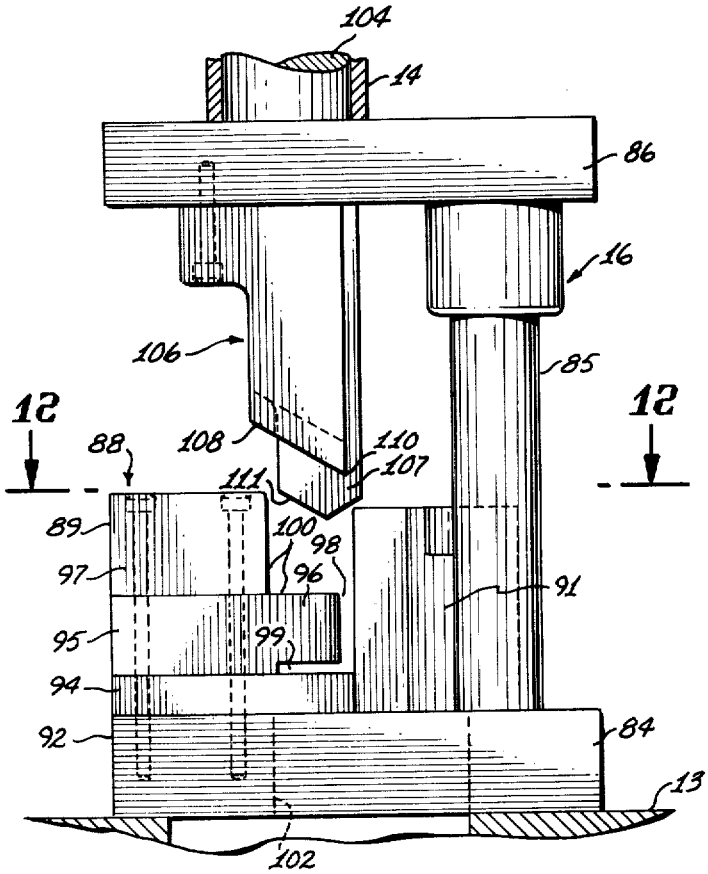
FIG. 10 is a side elevational view of the die set shown in FIG. 9.
Figure 11:
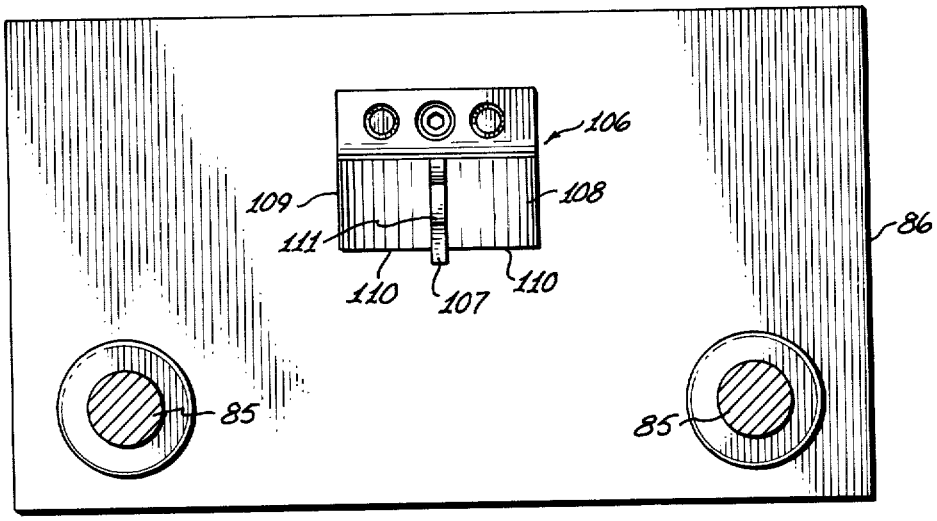
FIG. 11 is a sectional view taken on the line 11—11 of FIG. 9.

Referring now to FIGS. 9 through 12 wherein the die set 16 is shown as being mounted on the support plate 13, and as shown in FIG. 9 is aligningly disposed between the discharge end 40 of the input channel 11, and the receiving end 41 of the output channel 12.

The die set 16 includes a fixed pedestal 84 having a pair of vertical rods 85 extending therefrom. The rods 85 act as supporting guideways for a movable top plate 86 which is slidably journaled on the rods for reciprocal movement toward and away from the pedestal 84. The pedestal 84 also has a matrix or fixture die means 88 mounted thereon which guides lateral movement of the workpieces into a predetermined path through the die set 16, and supports the workpieces for the punching operation as will hereinafter be described.

Figure 12:
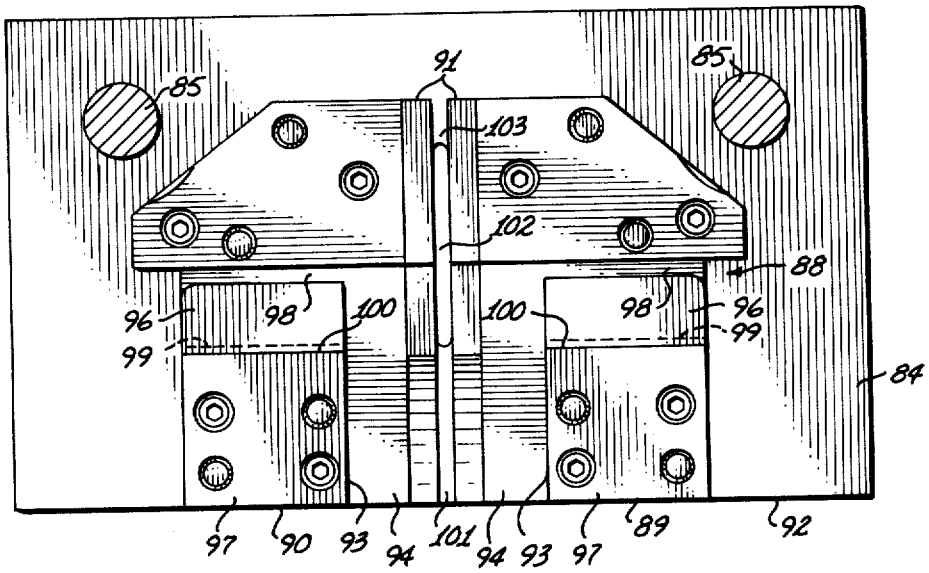
FIG. 12 is a sectional view taken on the line 12—12 of FIG. 10.

The fixture die means 88, as seen best in FIG. 12 includes a pair of supporting dies 89 and 90, and a backup die 91. The support dies 89 and 90 are mounted adjacent to the front edge 92 of the pedestal 84 and the backup die 91 is disposed rearwardly therefrom. The support dies 89 and 90 are spaced apart with respect to each other at their upper ends to provide a gap 93 therebetween. Each of the supporting dies 89 and 90 are formed with a base plate 94 which is directly mounted on the pedestal 84, an intermediate block 95 having a rearwardly extending cantilevered end 96, with the intermediate block 95 being mounted on the base plate 94, and an upper block 97 mounted atop the intermediate block 95. As seen best in FIGS. 10 and 12, the base plate 94 of each of the support dies 89 and 90 extends rearwardly from the front edge 92 of the pedestal 84 into engagement with the backup die 91. The intermediate blocks 95 extend rearwardly in the same manner but terminate just short of coming into contact with the backup die 91 to pro ide a horizontally extending vertical passage 98 between the cantilevered end 96 of the intermediate block 95 and the backup die 91. The intermediate block 95 is also recessed on its bottom surface to form a horizontally extending horizontal passage 99 between the cantilevered end 96 of the intermediate block 95 and the upper surface of the base plate 94. The vertical passage 98 and the horizontal passage 99 intersect and are normal to each other. The upper block 97 extends rearwardly from the front edge 92 of the pedestal 84 and terminates just short of the cantilevered end 96 of the intermediate block 95, thus providing horizontally extending enlarged passage 100 between the upper block 97 and the backup die 91. The base plates 94 of the supporting dies 89 and 90 are separated from each other by a slot 101 which extends from the front edge 92 of the pedestal 84, and a slot 103 in the backup die 91 is in alignment therewith. An elongated aperture 102 is formed in the pedestal 84, and this aperture 102 is vertically aligned with the slots 101 and 103. The aperture 102 is provided so that metal cut from the workpiece can drop through this aperture 102.

To facilitate understanding of the movement guiding and supporting functions of the fixture die means 88, positioning of the extrusion 19 therein will now be described. The vertical passage 98, between the cantilevered end 96 of the intermediate block 95 and the backup die 91, and the horizontal passage 99, between the cantilevered end 96 of the intermediate block 95 and the upper surface of the base plate 94, are adapted to slidingly receive the main angle member 35 of the extrusion 19. The main angle member 35 will extend upwardly through the vertical passage 98 into the enlarged passage 100 so that the secondary angle member 36 of the extrusion is disposed within the enlarged passage 100 with one leg of the secondary angle member 36 resting on the upper surface of the intermediate block 95 and the other leg bearing on the rearwardly disposed end of the upper block 97. Thus, the movement of the workpiece is transverse with respect to the gap 93 and slot 101 of the support dies 89 and 90 and is transverse to the slot 103 of the backup die 91.

The top plate 86 is provided with a boss 104 extending upwardly therefrom to which the punch press 14 is suitably coupled for providing the reciprocal movement of the top plate. The top plate 86 is provided with a cutting die means 106 depending from the downwardly facing surface thereof.

The cutting die means 106 is formed with a blade die 107 which is in vertical alignment with the slots 101 and 103 formed between the supporting dies 89 and 90 and between the backup die 91. Thus, downward movement of the top plate 86 will move the blade die 107 downwardly through the enlarged passage 100, through the vertical passage 98, and through the horizontal passage 99 into the slots 101 and 103, and will therefore sever the main angle member 36 of the extrusion 19 when that extrusion is positioned in the fixture die means 88.

The cutting die means 106 also includes a pair of wedge shaped dies 108 and 109 which are preferrably integral with the blade die 107 and are positioned on opposite sides thereof. Each of the wedge dies 108 and 109 are formed with a leading cutting edge 110 which is upwardly and laterally offset from the leading cutting edge 111 of the blade die 107.

The wedge dies 108 and 109 are in vertical alignment with the gap 93 provided between the support dies 89 and 90 of the fixture die means 88 so that downward movement of the top plate 86 will move the wedge dies 108 and 109 downwardly into the gap 93. The above described offset relationship of the wedge dies 108 and 109 with respect to the blade die 107 is critical so that downward movement of the cutting die means 106 will not bring the wedge dies into an intersecting relationship with the laterally extending paths of the vertical passage 98, the horizontal passage 99 or the rearwardly disposed portion of the enlarged passage 100. Therefore, when the extrusion 19 is positioned within the fixture die means 88, the main angle member 35 thereof will not be touched by the wedge dies 108 and 109 upon downward movement thereof, and these wedge dies will come into cutting contact only with that portion of the secondary angle member which is disposed within the gap 93.

Thus, the operation of the die set 16 can now easily be seen to sever the extrusion 19, into what may be defined as an outgoing length (not shown) and an incoming length (not shown), and simultaneously form a notch 39 in the secondary angle member 36 of the adjacent ends of the outgoing length and the incoming length.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claimed is:

1. An apparatus for punching an elongated multiflanged workpiece comprising:

a. a support plate;

b. die set means carried on said support plate for punching an elongated multiflanged workpiece when that workpiece is positioned therein, said die set means including a fixture die means having a workpiece supporting and movement path formed therethrough and cutting die means reciprocally movable in a path transverse to the workpiece supporting and movement path formed through the fixture die means;

c. the fixture die means of said die set means having a pair of support dies spaced apart with respect to each other to form a gap therebetween into which a portion of the cutting die means of said die set means is reciprocally movable, said pair of support dies each having an upper surface upon which portions of the multiflanged workpiece are slidingly movable in a path transverse to the gap between said pair of support dies, each of the upper surfaces of said pair of support dies having a horizontally extending vertical channel formed therein in which a portion of the multiflanged workpiece is slidingly movable in a path transverse to the gap between said pair of support dies;

d. the fixture die means of said die set means also having a backup die spaced from said pair of support dies to provide a horizontally extending vertical passage therebetween in which a portion of the multiflanged workpiece is slidingly movable in a path transverse to the gap between said pair of support dies, said backup die having a vertical channel formed therein which aligns with the gap between said pair of support dies and into which a portion of the cutting die means of said die set means is reciprocally movable;

e. input channel means on which the elongated multiflanged workpiece is slidably movable, said input channel means adjacent one side of said support plate and in workpiece directing alignment with the workpiece supporting and movement path formed through the fixture die means of said die set means;

f. output channel means on which the elongated multiflanged workpiece is slidably movable, said output channel means adjacent the opposite side of said support plate and in workpiece receiving alignment with the workpiece supporting and movement path formed through the fixture die means of said die set means; and g. punch press means coupled to said die set means for reciprocally moving the cutting die means thereof.

2. An apparatus as claimed in claim 1 wherein the fixture die means of said die set means further includes each of said pair of support dies having an aperture formed therein which extends vertically from their respective upper surfaces and into which portions of the cutting die means of said die means are reciprocally movable.

3. An apparatus as claimed in claim 1 wherein the fixture die means of said die set means further comprises a stripper mechanism mounted on each of said pair of support dies, said stripper mechanisms each having a cantilevered bar which spacedly overlays a portion of the upper surface of their respective ones of said pair of support dies to prevent upward movement of the multiflanged workpiece when that workpiece is slidingly supported thereon.

4. An apparatus as claimed in claim 1 wherein the fixture die means of said die set means further comprises a stripper mechanism mounted on said backup die, said stripper mechanism having at least one extending end which protrudes from said backup die so as to overlay the horizontally extending vertical passage provided between said pair of support dies and said backup die, said stripper mechanism for preventing upward movement of said multiflanged workpiece when that workpiece is slidably supportingly positioned in said die set means.

5. An apparatus as claimed in claim 1 wherein the fixture die means of said die set means further comprises a pair of spring loaded roller mechanisms each mounted adjacent a different one of said pair of support dies, said pair of spring loaded roller mechanisms engageable with the multiflanged workpiece for biasingly urging that workpiece toward said backup die when the multiflanged workpiece is positioned within said die set means.

* * * * *